United States Patent [19]

Villa et al.

[11] 4,290,466

[45] Sep. 22, 1981

[54] CONVERTIBLE CONTAINER-HOLDER THAT BECOMES THE NECK OF A FOLDING RECEPTACLE

[76] Inventors: Oscar Villa; Jorge A. Falcon, both of Rivadavia str. 4227, Buenos Aires, Argentina

[21] Appl. No.: 94,481

[22] Filed: Nov. 15, 1979

[51] Int. Cl.[3] ..... B65D 33/00

[52] U.S. Cl. ..... 150/1; 150/0.5; 150/48

[58] Field of Search ..... 150/0.5, 1, 8, 1.7, 150/48, 51; 215/11 E

[56] References Cited

U.S. PATENT DOCUMENTS

| | | | |
|---|---|---|---|
| 2,520,335 | 8/1950 | Piazze | 215/11 E |
| 2,729,257 | 1/1956 | Kepper | 150/1.7 |
| 2,865,421 | 12/1958 | Walsh | 150/48 |
| 3,261,458 | 7/1966 | Nibecker | 150/0.5 X |
| 3,374,929 | 3/1968 | Silfverskiold | 150/1 X |

*Primary Examiner*—Donald F. Norton
*Attorney, Agent, or Firm*—Norris & Bateman

[57] ABSTRACT

A convertible assembly that is adapted to hold a folded flexible container capable of being unfolded to a relatively large volume container and to effectively serve as the neck of that container when the latter is extracted and unfolded, comprising a rigid tubular member having reduced diameter opposite end portions formed with threads for mounting screw thread caps, and an internal ring mounted within the tube whereby upon removal of the caps and extraction of the folded container the neck of the container may be inserted through one tube end and positively held in place on the tube by the internal ring and material may be introduced into and dispensed from the unfolded container through the other tube end.

6 Claims, 3 Drawing Figures

CONVERTIBLE CONTAINER-HOLDER THAT BECOMES THE NECK OF A FOLDING RECEPTACLE

The present invention refers to a convertible container-holder that becomes the neck of a folding receptacle.

To be precise, the present invention covers a specified type of device, especially suitable for car drivers, although, because of its practicability, it can also serve for innumerable purposes of every kind, since it is made up of a basically cylinder-shaped case with caps at both ends; holding in its interior a receptacle of smooth, flexible material that can unfold easily, once the lower cap is removed, to hold any type of liquid; the upper cap being used specifically to close the neck. When the flexible receptacle is empty, it can be placed within the neck again and held in place by the putting on of its lower cap, thus the cartridge-shaped case can be easily kept in the glove compartment of a car, in a lady's purse or any other handy place without getting in the way of other objects. With the container-holder of the present invention many difficulties that arise in everyday activities can be overcome, especially where car drivers are concerned, since there is very often a need for an adequate receptacle for carrying water, petrol or gas-oil, etc. at unexpected moments and the best to be had at such a time are cumbersome or not large enough, whilst, having said cartridge-shaped case at hand, one would always be assured of having a practical container at such a time, since it is small in size when not in use yet, when opened up or unfolded, it is capable of holding several liters of liquid.

On the other hand, the container-holder of this invention allows for the flexible receptacle to be changed should it happen to break, leaving the neck and caps to serve for another receptacle.

The results mentioned are the direct outcome of a completely new combination of elements that make up the holder of this invention, which consists of a cylindrical tube that has a wider ring-shaped section protruding on its exterior surface, said section being midway between two male screw threads, apt for the fitting of conventional caps, whilst having in its interior a removable ring that fits up against its inner surface and having approximately the same length as the external male screw thread at the top, said removable ring being the means by which a bag of polyethylene or a similar type of material is held; said bag having a shaped neck to exactly fit inside said tube, so that said collar or neck becomes fixed between said tube and the removable ring.

The specified space within said cylindrical tube and between both caps is sufficient to hold the whole of said bag duly folded over several times, the result being that this can be achieved naturally without having to place the lower cap in position, said cap can only be placed in its position when said bag is within the device.

Preferably, both of the external sections can be screw threads, but, for example, the one corresponding to the lower cap can be of the type that is put on and held simply by pressure, or with a bayonet-type closing, etc. These are details that have no bearing with regard to the innovation of the invention. In the same way, optionally, the main tube could also have a holder or handle, which could be of cord or something similar to make it easier to carry the container or receptacle when full and, in the same way, the flexible bag could be elongated at its neck or collar making it apt for use as a peaked nozzle for pouring and it could also fold to fit within said tube when not in use.

In order to show the advantages briefly commented upon, to which consumers and experts in this speciality will add many others and in order to facilitate the understanding of the constructive and functional features of the invented container, a description of the preferred form of said invention is given herewith, which briefly illustrates same without any specified scale for the attached drawings, with the expressed explanation that, precisely because it deals with a sample, it is not suitable to assign it a limited or exclusive character of the scope of protection of the present invention, but simply to offer a mere explanatory or illustrated purpose of the basic conception on which same is based.

The same reference numbers in all the drawings indicate equal or corresponding parts or elements which go to make up the whole unit, according to the sample chosen from amongst many possibilities, which serves to explain this invention.

Figure 1:
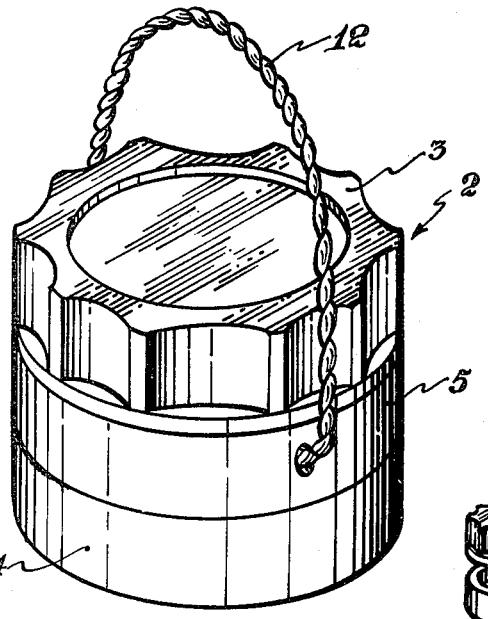
FIG. 1 is a perspective view of a container-holder according to this invention when not in use so that it can be kept ready to be put into use at any given moment.
Figure 2:
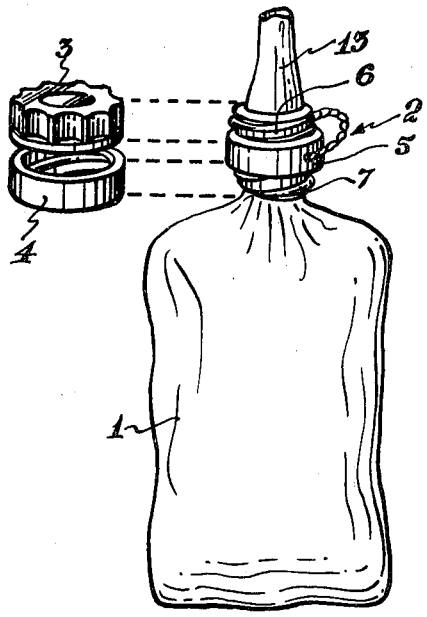
FIG. 2 shows, on a smaller scale, the same container as in FIG. 1 when in use, after having removed both of its caps and unfolded its flexible bag from its interior.

As can be seen from FIG. 1, with the complement of FIG. 2, the present invention consists of a waterproof material bag 1 such as polyethylene which, preferably, has an opening at the top of the same material that may be folded to be stored into a rigid tube 2 that has a top cap 3 and a bottom cap 4, that can be screwed or pressed into place, leaving the wider section 5 on the exterior of said tube to act as a stop for both caps.

Bottom cap 4 is the means by which bag 1 is held, duly folded, within said tube 2. Caps 3 and 4 close opposite ends of tube 2.

Figure 3:
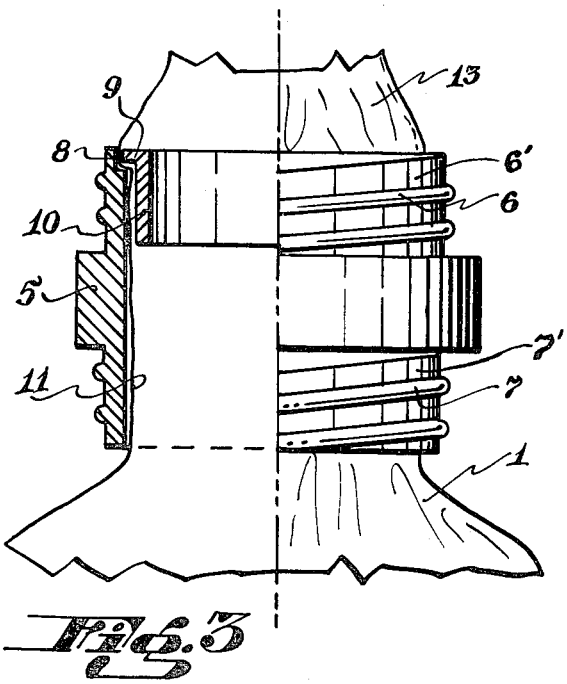
FIG. 3 shows, on a larger scale, a longitudinal section in accordance with FIGS. 1 & 2 and according to one of the variations foreseen for this invention.

As shown in FIGS. 2 and 3 the innovation of this invention lies in the fact that the neck is formed by the wide cylindrical tube 2, that has a protruding ring-like section 5 half-way down its exterior surface which separates the smaller diameter upper portion 6' bearing top screw thread 6 from the similar smaller diameter lower end portion 7' bearing the bottom screw thread 7 or of a shape so-designed as to hold cap 4. The first of said screw threads is for the conventional cap 3, which may have any kind of external shape, but the rim of said screw thread zone has a circumferential cut or groove 8 forming a shoulder upon which flange 9 of the removable internal ring 10 rests, thus fricitionally holding the neck or collar 11 of the polyethylene bag 1 firmly in place in assembly with tube 2. The holding ring 10 is held in the assembly of FIG. 1 by cap 3.

FIG. 1 shows the cord or optional handle 12 apt to take the weight of the whole unit when carrying liquid. The bag could have its neck 11 elongated and shaped to form a peaked nozzle 13 extending beyond tube 2, very useful to fit into the standard filling hole of a car body. With a diameter of less than 8 centimeters and even less than that in height, the complete cartridge-shaped case with both its caps in place could hold a folded bag that could take 5 liters or more.

When the present invention, so described and drawn, is put into practice certain modifications and/or improvements could be made, all or any of these should be considered as variations of the realization covered within the scope of protection of the present patent, a scope that is determined, basically, by the text of the claims that follow:

We claim:

1. A convertible assembly that is adapted to hold a folded flexible container and to effectively serve as the neck of said container when the latter is extracted and unfolded, comprising a rigid tubular member having opposite end portions formed with cap mounting means, closure caps removably mounted on said end portions, and an internal ring mounted within said tube, said tube being capable of enclosing a folded container having a reduced size neck at one end and which when unfolded can contain an appreciably larger volume of fluid material than said tube, and being so constructed and arranged that upon removal of said caps and extraction of the folded container the neck of the container may be inserted through one tube end and positively held in place on the tube by said internal ring, whereby material may be introduced into and dispensed from said container through the other tube end.

2. The convertible assembly defined in claim 1, wherein said tube has opposite end portions of reduced external diameter providing cap attachment formations, said caps when mounted on said end portions being in substantially end abutment with the portion of the tube between said end portions.

3. The convertible assembly defined in claim 2, wherein said cap attachment formations are screw threads.

4. The convertible assembly defined in claim 1, wherein said one end of the tube is recessed to form a shoulder and said internal ring has an external flange that is adapted to rest on said shoulder in the assembly and positively hold said container neck on the tube when the tube is combined with the unfolded container.

5. The convertible assembly defined in claim 4, wherein said cap at said one end of the tube holds said internal ring within the tube.

6. The convertible assembly defined in claim 1, wherein said tube is cylindrical with similar reduced end portions formed with external threads for mounting threaded closure caps that retain the folded container and the internal ring in the assembly.

* * * * *